US005913279A

United States Patent [19]

Braud et al.

[11] Patent Number: 5,913,279

[45] Date of Patent: Jun. 22, 1999

[54] BEARING ARRANGEMENT FOR LIMITING DEFLECTION OF A TURRET OF A TURRET MOORING DEVICE

[75] Inventors: Jean Braud; Leendert Poldervaart, both of La Turbie, Monaco

[73] Assignee: Single Buoy Moorings Inc., Marly, Switzerland

[21] Appl. No.: 08/913,269

[22] PCT Filed: Mar. 8, 1995

[86] PCT No.: PCT/EP95/00934

§ 371 Date: Dec. 8, 1997

§ 102(e) Date: Dec. 8, 1997

[87] PCT Pub. No.: WO96/27522

PCT Pub. Date: Sep. 12, 1996

[51] Int. Cl.[6] ..... B63B 21/00

[52] U.S. Cl. ..... 114/230.12; 114/293

[58] Field of Search ..... 441/3–5; 114/230, 114/293, 230.2; 384/193, 202, 215, 220, 221, 226, 247

[56] References Cited

U.S. PATENT DOCUMENTS

| | | | |
|---|---|---|---|
| 4,698,038 | 10/1987 | Key et al. | 441/5 |
| 5,346,314 | 9/1994 | Perratone et al. | 114/230 |
| 5,746,148 | 5/1998 | Delago | 114/293 |

FOREIGN PATENT DOCUMENTS

| | | |
|---|---|---|
| 0 227 279 | 7/1987 | European Pat. Off. . |
| WO 86/02329 | 4/1986 | WIPO . |
| WO 87/06555 | 11/1987 | WIPO . |

*Primary Examiner*—Ed L. Swinehart
*Attorney, Agent, or Firm*—Young & Thompson

[57] ABSTRACT

A turret mooring device includes a vessel carrying a turret, the turret being connected to the hull of the vessel by an upper and a lower bearing arrangement, the turret being provided with devices for fastening and guiding anchor lines and with at least one fluid line extending downwardly through the turret, the lower bearing arrangement being a slide bearing including a slide block having a sliding surface, and a slide plate, the slide block being connected to the outer wall of the turret and the slide plate being connected to the hull of the vessel, a clearance being provided between the slide block and the slide plate such that in case a bending moment exceeding a predetermined value is applied to the turret by the anchor lines relative to the upper bearing arrangement, the deflections of the turret are limited by contact of the slide block on the slide plate.

15 Claims, 2 Drawing Sheets

BEARING ARRANGEMENT FOR LIMITING DEFLECTION OF A TURRET OF A TURRET MOORING DEVICE

The invention relates to a turret mooring device consisting of a vessel carrying a turret vertically positioned within the hull or in front of the bow, said turret being connected to said hull of said vessel by means of an upper and a lower bearing arrangement, said turret being provided with means for fastening and guiding anchor lines and with at least one fluid line extending downwardly through said turret, wherein said lower bearing arrangement comprises a slide block having a sliding surface, and a slide plate, a clearance being present between said slide block and said slide plate for limiting deflections of said turret in case a bending moment is applied to said turret by said anchor lines relative to said upper bearing arrangement, which exceeds a predetermined value.

Turret mooring devices are for example used for mooring a vessel to a seabed, whereby the vessel can weathervane freely around the axis of the turret, wherein fluid line connections can be made from the vessel via the turret to a wellhead for example. The turret mooring holds the vessel on place under the influence of loads exerted upon the vessel caused by the action of waves, wind and current.

BACKGROUND OF THE INVENTION

A turret mooring device is known from WO-A-87/06555. The known turret mooring devices consist of a vessel carrying a turret vertically positioned within the hull or in front of the bow, wherein the turret is connected to the hull of the vessel by means of an upper and a lower bearing arrangement, the lower bearing arrangement being situated below water level, the turret being provided with means for fastening and guiding anchor lines and with at least one fluid line extending downwardly through the turret.

The known lower bearing arrangement comprises radial sliding bearings which are mounted on a lower turret unit and on a lower bearing ring that is placed against the bottom plates of the hull. Due to their concept, such bearings permit only a very slight displacement of bearing members relative to each other.

In case of mooring a vessel to a sea bed by the known turret mooring device, the combination of an upper and a lower contact bearing arrangement causes in the turret body both a high rotational torque due to rolling or sliding resistance of the lower bearing arrangement, in case the clearance between the lower bearing pads is relatively small. This may lead to a mooring force due to the dimensions and directions of loads exerted upon the vessel by the anchor lines.

In practice, the high rotational torque can achieve such a dimension, that the bearing arrangement is inhibited from rotating, thus causing twisting of the flexible riser system located underneath the turret relative to the vessel. Such twisting can cause failure of the riser system and thereby spillage of oil out of the lines extending between a wellhead and the vessel.

Sometimes, in turret mooring devices the lower bearing arrangement is omitted for preventing the occurrence of such heavy torques and forces. Obviously, in this case the upper bearing arrangement has a more severe task whereby both the bearing arrangement and its supporting means have to be designed to much higher forces, if it can be designed at all.

Moreover, known lower bearing arrangements are located below water level. Thus, service and exchanging of parts is hard to do.

The object of the invention is to provide a lower bearing arrangement for a turret mooring device which reduces the negative effects of a one bearing arrangement and gives the benefits of a double bearing arrangement to a great extent, wherein easy service and exchange of parts is possible.

SUMMARY OF THE INVENTION

According to the invention the turret mooring device is characterized in that said slide block is connected to a wall of said turret and said slide plate being connected to said hull of said vessel, wherein said slide block is shiftably guided within a casing connected to said turret, the axis of said slide block being aligned with respect to the axis of said casing. During relative easy or normal conditions the turret mooring device operates with only the upper bearing arrangement in use. In case conditions become such that a bending moment occurs in the turret body, thus causing deflection of the turret relative to upper bearing arrangement and the bending moment exceeds a predetermined dimension, parts of the lower bearing arrangement abut eachother, thus limiting further deflection. The clearance provided in the lower bearing arrangement during normal conditions allows non-frictional rotation of slide block and plate with respect to each other, and on the other hand limits deflection in case of extreme bending moments occurring temporarily. As said extreme moments occur only during a very short moment the lower bearing does not really become locked.

To enable easy service and exchange of parts the slide block is removably mounted in the casing, which slide block can be shifted out after removal of the cover.

According to a further aspect of the invention the casing contains of at least one shock absorbing device for absorbing shocks caused by bumping the slide block against the slide bearing. Obviously, severe loads are exerted upon the slide block when abutting the slide plate. Such a shock absorbing device may be a bumper pad positioned in the casing between the slide block and the closing cover.

According to a further aspect of the invention the slide plate is connected to the turret and the slide block to the vessel.

BRIEF DESCRIPTION OF THE DRAWINGS

The invention will be further elucidated referring to an embodiment of the invention shown in the drawings, wherein.

DETAILED DESCRIPTION OF THE INVENTION

Figure 1:
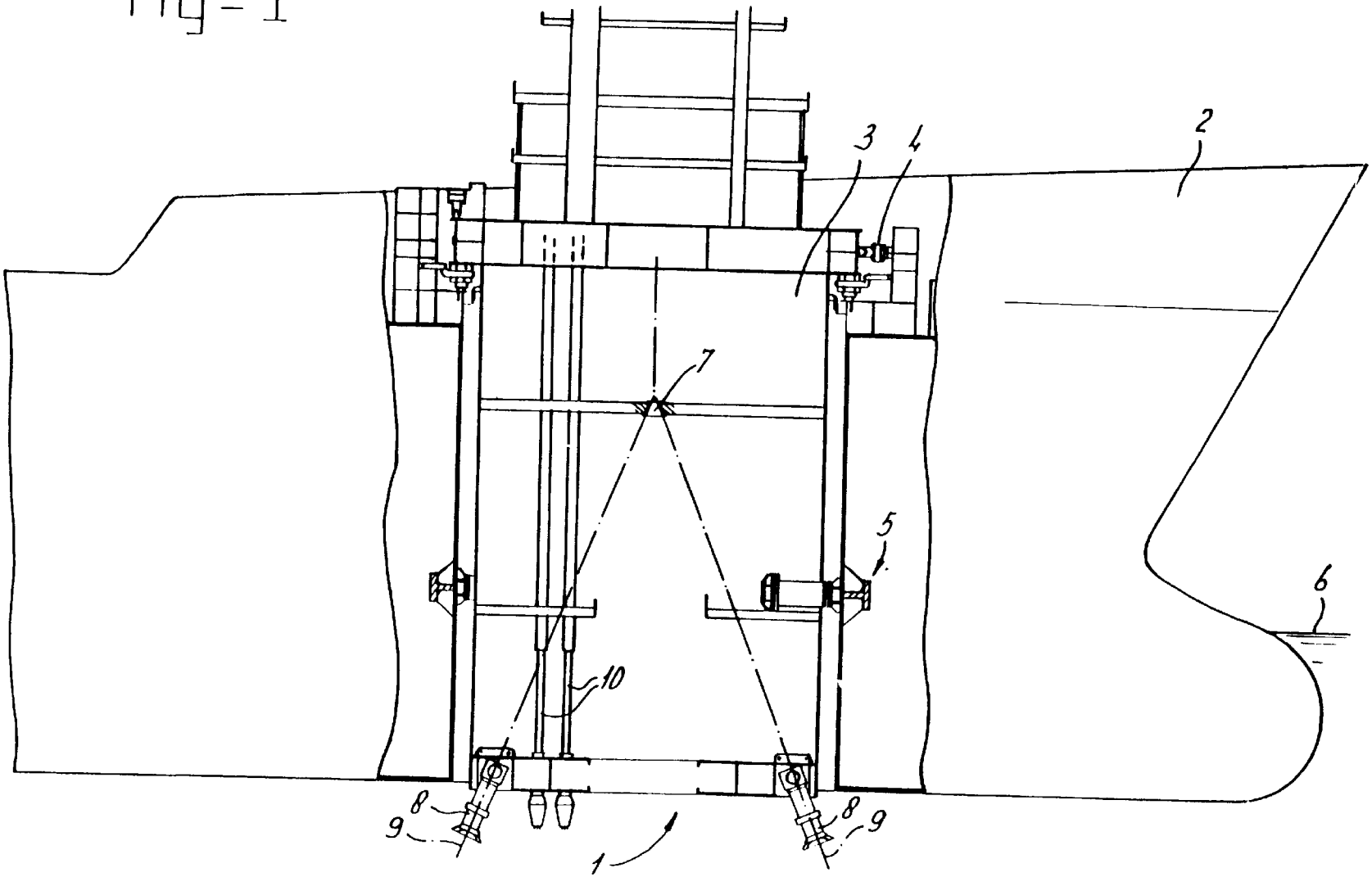
FIG. 1 shows in sectional side view a vessel carrying a turret vertically positioned within the hull, according to the invention.

In FIG. 1 a preferred embodiment of the turret mooring device 1 according to the invention is shown. The turret mooring device 1 consists of a vessel 2 carrying a turret 3 vertically positioned within the hull of the vessel 2. The turret 3 is connected to the hull of the vessel 2 by means of an upper and a lower bearing arrangement 4, 5. The lower bearing arrangement 5 can be situated below water level 6. The turret 3 is provided with means 7, 8 for fastening and guiding anchor lines 9. At least fluid line 10 extends downwardly through the turret 3. Through this fluid line may be transported to the vessel.

Figure 2:
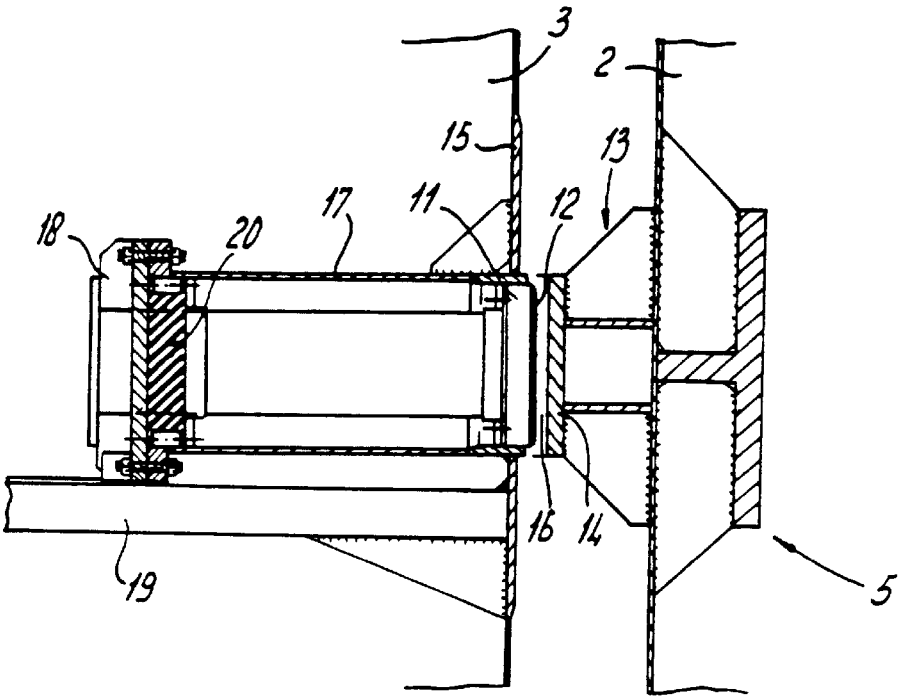
FIG. 2 shows in sectional side view the lower bearing on an enlarged scale in the installed position according to the invention.

In FIG. 2 the lower bearing arrangement 5 of FIG. 1 is shown on an enlarged scale in the installed position. The lower bearing arrangement 5 comprises a slide block 11 having a sliding surface 12, and a slide plate support 13 carrying a slide plate 14. The slide block 11 is supported by the wall 15 of the turret 3 and the slide plate support 13 is connected to the hull of the vessel 2. The slide plate 14 is connected to the hull of the vessel 2 by suitable reinforcement means which form the support 13. A clearance 16 is present between the slide block 11 and the slide plate 14. In case a bending moment on the turret exceeds a predetermined value, the sliding surface 12 abuts the slide plate 14, thus limiting deflection of the turret 3 inside the hull. The slide block 11 is shiftably supported by the wall 15 of the turret 3 by means of a radial casing 17 closed by a closing cover 18, the axis of the slide block 11 being aligned substantially with the axis of the casing 17. The casing 17 is supported by means of a supporting platform 19. In practice suitable reinforcement means may be applied for connecting the casing 17 to the supporting platform 19 as well as for connecting the supporting platform 19 to the wall 15 of the turret 3. The casing 17 has at least one shock absorbing device 20, such as a bumper pad between the slide block 11 and the closing cover 18, for absorbing shocks caused by bumping of the slide block 11 against the slide plate 14.

Figure 3:
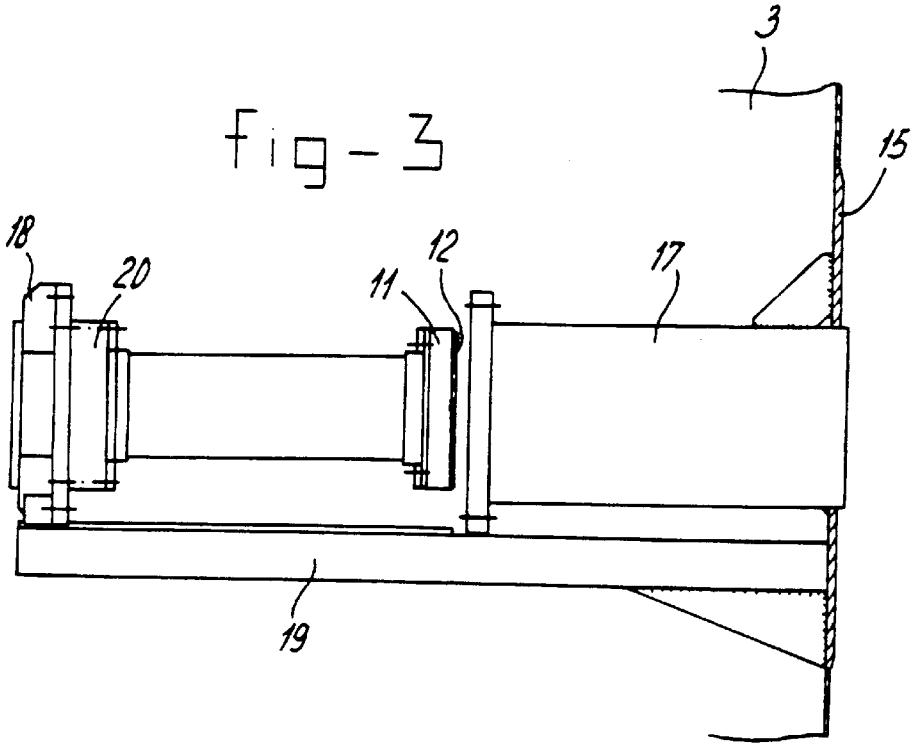
FIG. 3 shows in sectional side view the lower bearing according to FIG. 2 in a retrieved position.

In FIG. 3 the lower bearing arrangement 5 of FIG. 2 is shown in a pulled out position. Corresponding elements are indicated by corresponding reference signs. The slide block 11 is removably mounted in the casing 17 for ease of service and exchanging slide blocks 11. The closing cover 18 may be slidably connected to the supporting platform 19.

We claim:

1. A turret mooring device comprising:

a vessel carrying a turret;

said turret being vertically positioned within a hull of said vessel or in front of a bow of said vessel;

said turret being connected to said hull of said vessel by an upper and a lower bearing arrangement;

said turret being provided with fastening means for fastening and guiding anchor lines, and with at least one fluid line extending downwardly through said turret;

said lower bearing arrangement comprising a slide block having a sliding surface, and a slide plate, said lower bearing arrangement being designed and constructed to provide a clearance between said slide block and said slide plate for limiting deflections of said turret in case a bending moment exceeding a predetermined value is applied to said turret by said anchor lines relative to said upper bearing arrangement;

said slide block being slidably connected to a wall of said turret;

said slide plate being connected to said hull of said vessel; and said slide block being shiftably guided within a casing connected to said turret, an axis of said slide block being aligned with respect to an axis of said casing.

2. The turret mooring device of claim 1, wherein said slide block is removably mounted in said casing.

3. The turret mooring device of claim 1, wherein said casing comprises a shock absorbing device for absorbing shocks caused by bumping said slide block against said slide plate.

4. The turret mooring device of claim 3, wherein said casing further comprises a closing cover and said shock absorbing device comprises a bumper pad positioned between said slide block and said closing cover.

5. The turret mooring device of claim 6, wherein said slide block maintains said sliding surface parallel and spaced apart from said slide plate.

6. A turret mooring device comprising:

a vessel carrying a turret;

said turret being vertically positioned within a hull of the vessel;

said turret being connected to said hull of said vessel by an upper and a lower bearing arrangement;

said turret being provided with fastening means for fastening and guiding anchor lines, and with at least one fluid line extending downwardly through said turret;

said lower bearing arrangement comprising a slide block and a slide plate, said lower bearing arrangement being designed and constructed to provide a contact-free clearance between said slide block and said slide plate;

said slide plate being connected to said hull of said vessel;

said slide block being shiftably guided within a casing connected to said turret; and said slide block being designed and constructed to limit deflections of said turret by closing said contact-free clearance between said slide block and said slide plate when a bending moment exceeding a predetermined value is applied to said turret by said anchor lines relative to said upper bearing arrangement.

7. The turret mooring device of claim 6, wherein said slide block is removably mounted in said casing.

8. The turret mooring device of claim 6, wherein said casing comprises a shock absorbing device for absorbing shocks caused by bumping said block against said slide plate.

9. The turret mooring device of claim 8, wherein said casing further comprises a closing cover and said shock absorbing device comprises a bumper pad positioned between said slide block and said closing cover.

10. The turret mooring device of claim 6, wherein said slide block is maintained parallel and spaced apart from said slide plate.

11. A turret mooring device comprising:

a vessel carrying a turret vertically positioned within a hull of the vessel;

said turret being connected to said hull by an upper bearing arrangement and a lower bearing arrangement;

said turret being provided with fastening means for fastening and guiding anchor lines, and with at least one fluid line extending downwardly through said turret;

said lower bearing arrangement comprising a slide block and a slide plate, said slide block being designed and constructed to provide a contact-free clearance apart from said slide plate when said turret is free from bending moments;

said slide plate being connected to said hull of said vessel;

said slide block being shiftably guided within a casing connected to said turret; and said slide block being designed and constructed to limit deflections of said turret by closing said contact-free clearance between said slide block and said slide plate upon application of a bending moment exceeding a predetermined value to said turret by said anchor lines relative to said upper bearing arrangement.

12. The turret mooring device of claim 11, wherein said slide block is removably mounted in said casing.

13. The turret mooring device of claim 12, wherein said casing comprises a shock absorbing device for absorbing shocks caused by bumping said slide block against said slide plate.

14. The turret mooring device of claim 13, wherein said casing further comprises a closing cover and said shock absorbing device comprises a bumper pad positioned intermediate said slide block and said closing cover.

15. The turret mooring device of claim 14, wherein said slide block is aligned parallel to and spaced apart from said slide plate.

* * * * *